US008182970B2

(12) United States Patent
Sakimura et al.

(10) Patent No.: US 8,182,970 B2
(45) Date of Patent: May 22, 2012

(54) IMAGE FORMING METHOD

(75) Inventors: Tomoo Sakimura, Tokyo (JP); Hirohiko Seki, Yamanashi (JP); Nobuaki Kobayashi, Tokyo (JP); Tadaaki Sumitani, Tokyo (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 444 days.

(21) Appl. No.: 12/469,017

(22) Filed: May 20, 2009

(65) Prior Publication Data

US 2009/0297972 A1 Dec. 3, 2009

(30) Foreign Application Priority Data

May 28, 2008 (JP) ..... 2008-139355

(51) Int. Cl.
*G03G 15/04* (2006.01)

(52) U.S. Cl. ..... 430/66

(58) Field of Classification Search ..... 430/66; 399/159, 346

See application file for complete search history.

(56) References Cited

U.S. PATENT DOCUMENTS

2003/0044201 A1* 3/2003 Kosuge ..... 399/223
2006/0099524 A1* 5/2006 Takenouchi ..... 430/56
2006/0257771 A1* 11/2006 Wayman et al. ..... 430/59.4

* cited by examiner

*Primary Examiner* — Thorl Chea
(74) *Attorney, Agent, or Firm* — Lucas & Mercanti, LLP

(57) ABSTRACT

An electrophotographic image forming method is disclosed. The method includes electrically charging a photoreceptor, imagewise exposing the photoreceptor so that a latent image is formed on the photoreceptor, supplying a lubricant on a surface of the photoreceptor, and developing the latent image with a toner so that a toner image is formed on the photoreceptor, transferring the toner image and cleaning the photoreceptor, in which the photoreceptor has an electro-conductive substrate, a photosensitive layer and a protective layer containing inorganic particles, a ratio $RSm/D_{50}$ of an average length of surface roughness profile element in the direction making a right angle with the driving direction of the photoreceptor RSm (μm) to a number-based median diameter of the toner $D_{50}$ is from 0.4 to 2.0, and a skewness of the surface roughness profile of the photoreceptor in the direction making a right angle with the driving direction of the photoreceptor Rsk is from −3.0 to 0.0.

10 Claims, 6 Drawing Sheets

IMAGE FORMING METHOD

This application is based on Japanese Patent Application No. 2008-139355 filed on May 28, 2008, in Japanese Patent Office, the entire content of which is hereby incorporated by reference.

TECHNICAL FIELD

The present invention relates to an image forming method using an electrophotographic photoreceptor.

TECHNICAL BACKGROUND

Image formation is carried out by a series of processes of electric charging, exposure, development, transfer and cleaning on the surface of an electrophotographic photoreceptor, hereinafter also simply referred to as photoreceptor, used for the electrophotographic image forming method. Recently, organic photoreceptor using an organic compound is widely applied as the electrophotographic photoreceptor. As to the organic photoreceptor, influence to the environment of it is low and ones capable of corresponding to various light wavelengths of light are easily developed.

At early time, the organic photoreceptor had problem of durability versus mechanical external force or chemical action. In concrete, occurrence of wearing or scratches by friction with the charging means, developing means, transferring means or cleaning means, and surface degradation caused by active oxygen such as ozone or nitrogen oxide formed on the occasion of the corona charging were tend to occur.

Many trials have been carried out for improving the durability of the surface of organic photoreceptor. As an example, it was tried to make the charge transfer layer to double layer for raising the physical strength of the photoreceptor surface or to add silica particles in the outermost layer for raising the mechanical strength of the photoreceptor surface, cf. Patent Documents 1 and 2 for example. As results of such the efforts of the investigation, the durability of the organic photoreceptor has been considerably improved recently.

It is usual method for improving the durability to raise the anti-wearing property by raising the hardness of the surface. However, a problem is caused that the surface property of the photoreceptor tends to be degraded, tar from improving, by such the method. It is made clear that adhesion of the toner and reaction products formed by chemical reaction with ozone onto the photoreceptor surface is caused accompanied with the image formation and such the foreign materials should be effectively removed for keeping the stable image quality. On the usual photoreceptor having low anti-wearing ability, the foreign materials can be removed together with wearing of the photoreceptor surface, but the foreign materials are difficultly removed from the photoreceptor surface which is difficultly worn. As a result of that the degradation of the surface property of photoreceptor is caused.

Recently, image forming apparatuses using the electrophotographic technology are improved from various viewpoints so that high quality printed images can be obtained at high speed. Therefore, the image forming apparatuses utilizing electrophotography are begun to be applied in the field of short-run printing.

In the field of short-run printing, different from in the office-use, character images are often printed on a solid image accompanied with the consumption of a large amount of toner, for example, yellow letter images printed on a blue background.

A problem of occurrence of raindrop-like image defects (stains) on the printed image is caused when the images with the consumption of a large amount of toner such as solid images are continuously printed by the above image forming apparatus.

The occurrence of raindrop-like image defect is a phenomenon that toner fine particles and the external additives of the toner, which are rightfully removed by the cleaning device, slip through the cleaning device and adhere onto the photoreceptor surface in a form of lump having a width of from 2 to 200 μm and a length of from 10 μm to 2 cm and adhering portion is appeared as the raindrop-like defect on the printed image.

For raising the cleaning ability, an image forming apparatus in which a means for applying a lubricant onto the photoreceptor surface has been proposed, cf. Patent Document 3 for example.

Patent Document 1: JP A H02-160247
Patent Document 2: JP A H07-333881
Patent Document 3: JP A 2003-58009

DISCLOSURE OF THE INVENTION

An object of the invention is to provide an image forming method by which high resolution images without the raindrop-like image defect can be obtained even when image printing with high consumption of toner such as solid image is continuously carried out.

MEANS FOR SOLVING THE PROBLEMS

An embodiment of the invention is an electrophotographic image forming method using an image forming apparatus which has a charging device, an exposing device, a developing device, a transferring device, a photoreceptor and a lubricant applying device, and the photoreceptor has an electroconductive substrate, a photosensitive layer and a protective layer containing an inorganic particle, in which a ratio RSm/$D_{50}$ of an average length of surface roughness profile element in the direction making a right angle with the driving direction of the photoreceptor RSm (μm) to a number-based median diameter of the toner to be used for image formation $D_{50}$ is from 0.4 to 2.0 and a skewness of the surface roughness of the photoreceptor in the direction making a right angle with the driving direction of the photoreceptor Rsk is from −3.0 to 0.0.

The image forming method comprises steps of: electrically charging a photoreceptor, imagewise exposing the photoreceptor so that a latent image is formed on the photoreceptor, supplying a lubricant on a surface of the photoreceptor, developing the latent image with a toner so that a toner image is formed on the photoreceptor, transferring the toner image, and removing residual toner on a surface of the photoreceptor by a cleaning device. The toner image formed on the photoreceptor is transferred to a recording material such as paper directly or via an intermediate transfer member.

The lubricant is preferably a fatty acid metal salt.

The fatty acid metal salt is preferably zinc stearate.

The protective layer preferably contains inorganic particle having a number-average primary particle diameter of from 1 to 300 nm.

The electrophotographic image forming method of the invention has superior effects that high resolution printed images without raindrop-like image defect or streak image defect can be obtained even when images consuming a large amount of toner, such as a solid image, are continuously printed.

PREFERRED EMBODIMENTS OF THE INVENTION

Figure 1A:
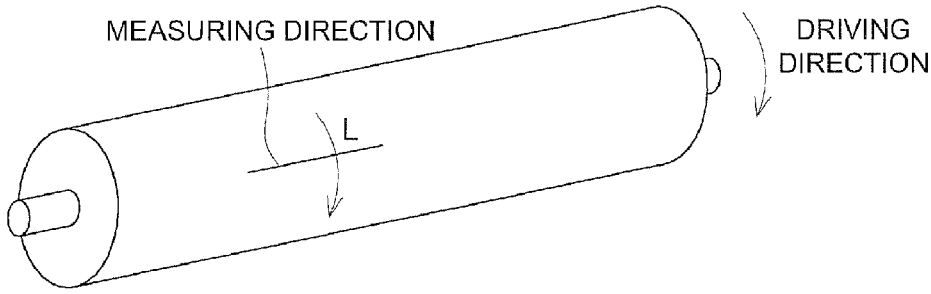
FIGS. 1*a* and 1*b* show the portion where RSm and Rsk of the photoreceptor are measured.

There is a problem that the raindrop-like image defects are caused on the printed images when the images accompanied with consumption of a large amount of toner (images formed by adhering a large amount of the toner) on which a large amount of toner adheres) is continuously printed using the photoreceptor containing the inorganic particles in the protective layer thereof. The inventors investigate the reason of causing of such the problem.

It has been known that the photoreceptor surface has some irregularity on its surface. This invention is based on the solution of the problem of image defect by investigation on the geometrical shape of the surface, not only simple irregularity.

It is found that the lubricant is captured by the photoreceptor when the photoreceptor has a specific surface shape and effects as lubricant without occurrence of any image defect.

From such the viewpoint, the inventors have investigated the relation of the shape of the photoreceptor surface to the lubricant capturing ability and maintaining ability.

As a result of the investigation, it has been found that the above problem can be solved by using a photoreceptor having a specified ratio of the average length of surface roughness profile element RSm to the toner diameter and a specified value of the skewness Rsk of the surface roughness profile.

The invention is described in detail below.

The surface property of the photoreceptor is described.

<<Surface Properties Rsm and RSk of Photoreceptor>>

The photoreceptor to be used in the invention has the substrate, photosensitive layer and the protective layer containing the inorganic particles, and the ratio ($Rsm/D_{50}$) of the average length Rsm (μm) of the surface roughness profile elements of the photoreceptor to the median diameter $D_{50}$ of the toner to be used for image formation is from 0.4 to 2.0, and the skewness Rsk of the surface roughness profile in the direction making a right angle with the driving direction of the photoreceptor is from −3.0 to 0.0.

On the photoreceptor having the above surface, the toner particles are not entered into roughened portion of the surface on the occasion of printing and the lubricant is only captured and kept for a long period so that a certain amount of lubricant can be fixed at the surface of photoreceptor.

In The electrophotographic image forming method of the invention, the image forming apparatus in which the photoreceptor is installed, which has the ratio ($RSm/D_{50}$) of the average length of surface roughness profile elements RSm (μm) in the direction making a right angle with the driving direction of the photoreceptor to the number-based median diameter $D_{50}$ (μm) of the toner to be used for image formation of from 0.4 to 2.0 and the skewness Rsk of the surface roughness profile of the photoreceptor surface in the direction making a right angle with the driving direction of photoreceptor of from −0.3 to 0.0.

The skewness of the surface roughness profile of the photoreceptor is preferably from −2.5 to −0.5 and particularly preferably from −2.5 to −1.0.

The ratio $RSm/D_{50}$ is preferably from 0.5 to 1.5.

The preferable value of RSm cannot be decided only by the photoreceptor and is decided by the relation with the median diameter $D_{50}$ of the toner used for image formation.

For concrete example, RSm is from 12 to 16.0 μm when the toner having a number-based median diameter $D_{50}$ of from 3 to 8 μm is used and the ratio of RSm to the toner diameter is from 0.4 to 2.0.

RSm of from 2 to 12 μm is generally preferable.

The average length of the surface roughness profile element RSm and the skewness of the surface roughness profile are defined by ISO 4287-1997.

The average length of RSm is an average value calculated from the sum of the length of average line corresponding to a peak and a groove adjacent to the peak within the standard length l in the direction of the average line extracted from the roughness curve. The unit of RSm is micron meter.

The skewness Rsk of roughness curve is an indicator expressing the shifting degree of the distribution of the height of surface profile from the regular distribution. The value is 0 when the distribution of height is regular. The value becomes negative when the surface is constituted by the combination of groove portions and positive when the surface is constituted by the combination of peak portions. Rsk is a non-dimensional value.

Figure 7A:
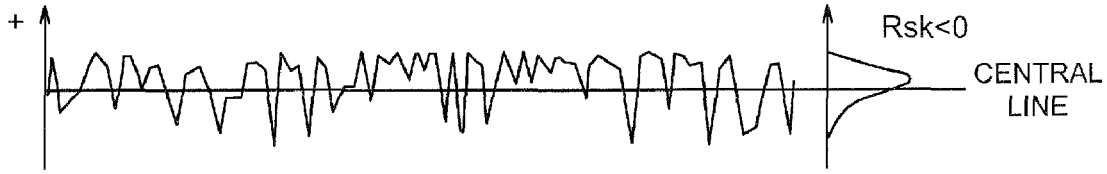
FIGS. 7*a*, 7*b* and 7*c* show schematic surface profile for describing Rsk.
Figure 7B:
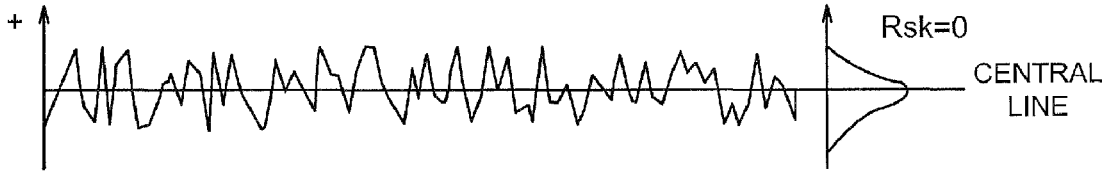
Figure 7C:
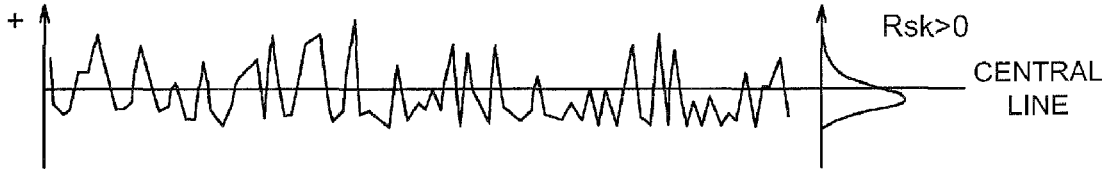

The skewness is smaller than 0 when the peak value of the surface profile shifts to the upper side of center line, namely shifted to peak side as shown in FIG. 7*a*, and the value is larger than 0 when the peak value of the surface profile shifts to lower side of the center line, namely groove side as shown in FIG. 7*c*. When the peak value of the surface profile is near the center line, the skewness value becomes almost 0 as shown in FIG. 7*b*.

(Measurement of RSm and Rsk)

FIG. 1 shows the position where RSm and Rsk of the photoreceptor are measured.

FIG. 1*a* shows the direction making a right angle with the driving direction of the photoreceptor in which RSm and Rsk are measured.

Figure 1B:
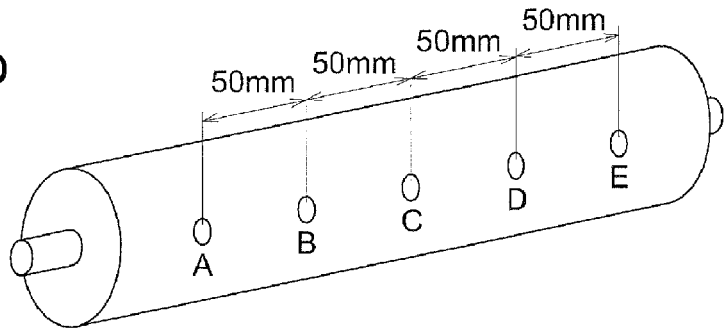

FIG. 1*b* shows the positions where RSm and Rsk are measured, the measurements are carried out at five points of A to E and average values of measured at the five points are defined as the RSm and Rsk values, respectively.

RSm and Rsk can be measured by Surfcom 1400D manufactured by Tokyo Seimitsu Co., Ltd.

Point of detecting stylus: 0.5 R (0.5 μm)

Measuring length: 2 mm

Measuring rate: 0.03 mm/sec

Cutoff: 0.08 mm

Threshold peak value: 0

RSm is defined by the following formula.

$$RSm = \frac{1}{n}\sum_{i=1}^{n} Smi$$

In the formula, Smi is the width of the i-th surface profile element within the sampling length. n is a number of calculation.

RSk is defined by the following formula.

$$Rsk = \frac{1}{Rq^3}\left[\frac{1}{lr}\int_0^{lr} Z^3(x)\,dx\right]$$

Wherein Rq is root mean square deviation of the surface profile, lr is a sampling length, Z(x) is an amplitude distribution function of roughness profile of surface of the photoreceptor.

The image forming apparatus according to this invention is described.

<Image Forming Apparatus>

The image forming apparatus comprises a charging device, an image exposure device, a developing device, a transfer device, a photoreceptor and a lubricant applying device.

Figure 2:
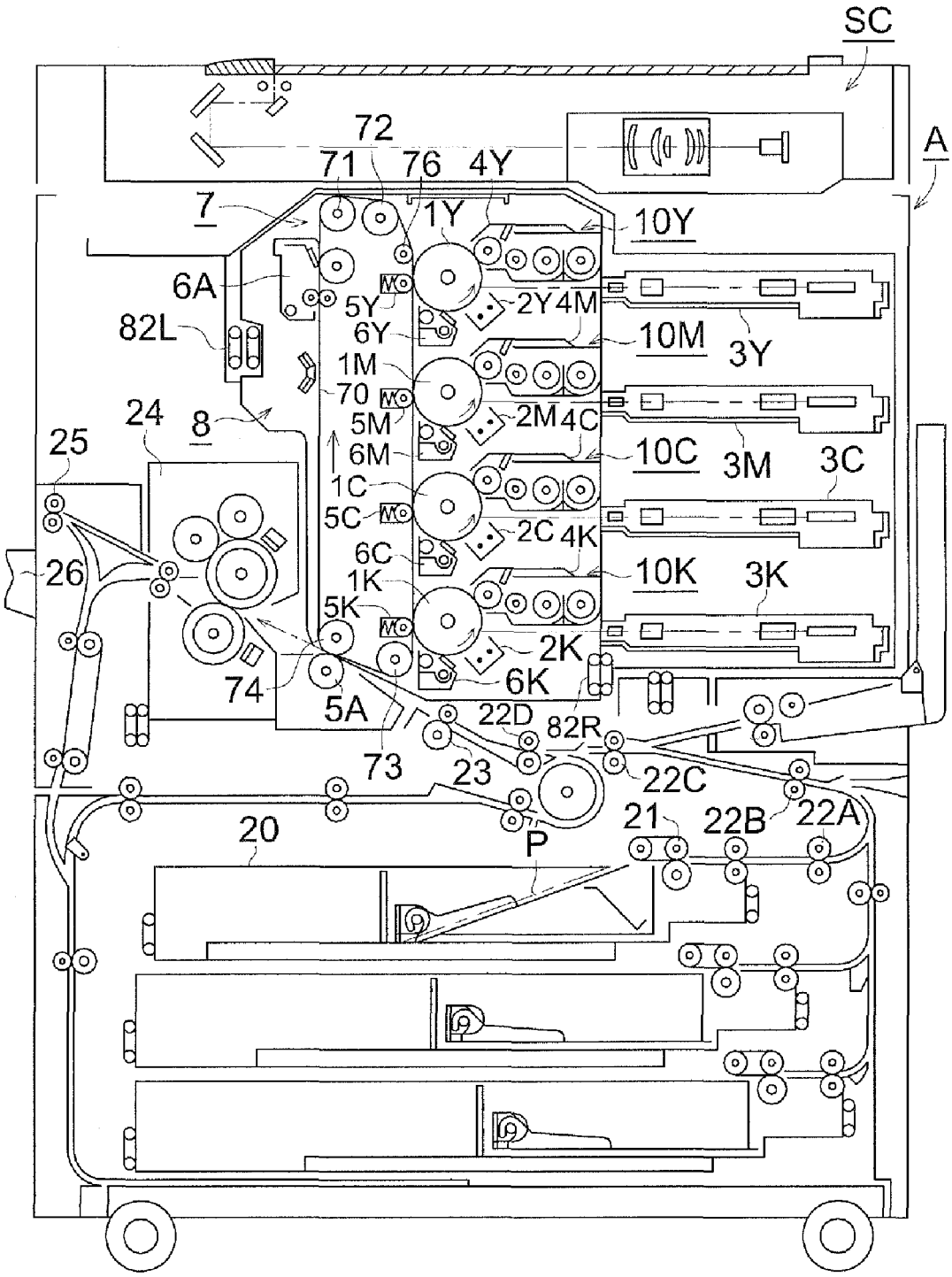
FIG. 2 shows a cross section of a color image forming apparatus usable in the invention.

The image forming method is described more in detail by referring to an image forming apparatus illustrated in FIG. 2.

FIG. 2 is a cross-sectional construction diagram of a color image forming apparatus, showing an embodiment of the invention.

This color image forming apparatus is called a tandem type color image forming apparatus and is comprised of a set of plurality of image forming sections 10Y, 10M, 10C, and 10K, endless-belt shape intermediate transfer unit 7, sheet convey device 21, and fixing device 24. Document image reading device SC is arranged on body A of the image forming apparatus.

The image forming section 10Y that forms yellow image is comprised of charging device 2Y, exposure device 3Y, developing device 4Y, primary transfer roller 5Y, and cleaning device 6Y, which are arranged around drum shape photoreceptor 1Y as a first image carrier. The image forming section 10M that forms magenta images is comprised of drum shape photoreceptor 1M, charging device 2M, exposure device 3M, developing device 4M, primary transfer roller 5M, and cleaning device 6M. The image forming section 10C that forms cyan images is comprised of drum shape photoreceptor 1C as a first image carrier, charging device 2C, exposure device 3C, developing device 4C, primary transfer roller 5C as primary transfer means, and cleaning device 6C. The image forming section 10K that forms black images is comprised of drum shape photoreceptor 1K as a first image carrier, charging device 2K, exposure device 3K, developing device 4K, primary transfer roller 5K as primary transfer means, and cleaning device 6K.

The endless-belt shape intermediate transfer unit 7 is windingly circulated by a plurality of rollers and has second endless-belt shaped semiconductive intermediate transfer member 70, which is supported by rollers and circulated.

Images in respective colors formed by the image forming sections 10Y, 10M, 10C, and 10K are sequentially transferred onto the rotating endless-belt shape intermediate transfer member 70 by the primary transfer rollers 5Y, 5M, 5C, and 5K so that a composite color image is formed. A recording medium sheet P received in sheet feeding cassette 20 is fed by sheet feeding device 21, conveyed to secondary conveying roller 5A through a plurality of intermediate rollers 22A, 22B, 22C, 22D, and registration roller 23, and then, the color image is secondarily transferred onto the sheet P in one-shot. The sheet P (recording material) on which the color image has been transferred is fixed by fixing device 24, sandwiched by exit roller 25, and mounted on exit tray 26 outside the machine.

On the other hand, after the color image has been transferred to the sheet P by the secondary transfer roller 5A, the endless-belt type intermediate transfer member 70, from which the sheet P has self-striped, is removed of residual toner by cleaning device 6A.

During the image forming processing, the primary transfer roller 5K is all the time pressed against the photoreceptor 1K. The other primary transfer rollers 5Y, 5M, and 5C are pressed against the respective photoreceptors 1Y, 1M, and 1C only when the respective color images are formed.

The secondary roller 5A is pressed against the endless-belt shape intermediate transfer member 70 in contact therewith only when the sheet P passes through between them and the secondary transfer is carried out.

Housing 8 can be drawn out from the apparatus body A, guided by supporting rails 82L and 82R.

In the housing 8, there are arranged the image forming sections 10Y, 10M, 10C, 10K, and the endless-belt shape intermediate transfer unit 7.

The image forming sections 10Y, 10M, 10C, and 10K are disposed vertically in alignment. The endless-belt shape intermediate transfer unit 7 is disposed on the left side, in the figure, of the photoreceptors 1Y, 1M, 1C, and 1K. The endless-belt shape intermediate transfer unit 7 is comprised of the endless-belt shape intermediate transfer member 70 which is circulative and windingly rotated by the rollers 71, 72, 73, 74, and 76, the primary transfer rollers 5Y, 5M, 5C, 5R, and the cleaning device 6A.

The image forming apparatus of this invention has a lubricant supplying device which supplies a lubricant to a surface of a photoreceptor. The lubricant supplying device may be arranged at the appropriate positions around the electrophotographic photoreceptor. The installation may be carried out partially employing the charging device, the development device, and/or the cleaning device shown in FIG. 2, to efficiently use the installation space. An example in which the cleaning device is employed together with the agent providing device is described below.

Figure 3:
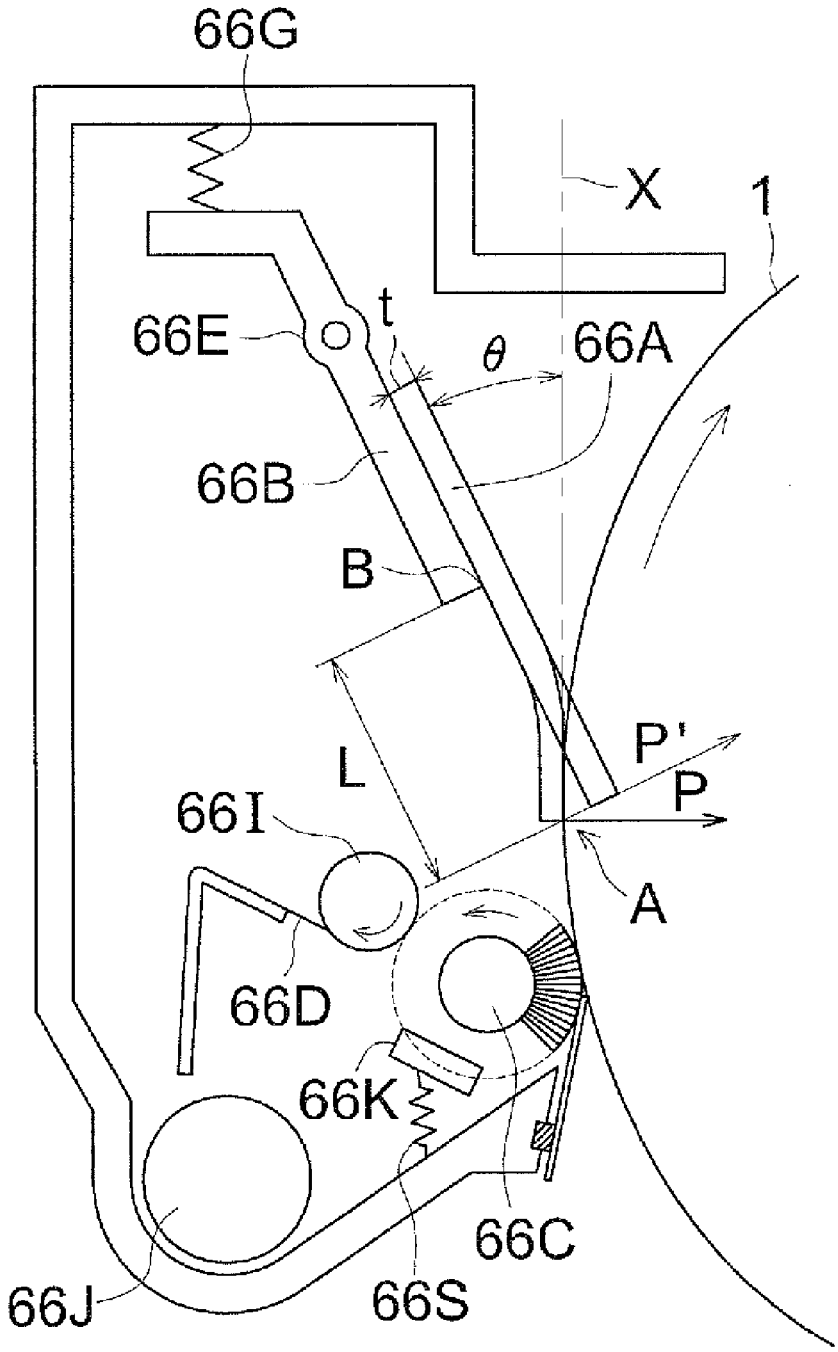
FIG. 3 shows constitution of a cleaning device combined with a lubricant applying device.

FIG. 3 shows a schematic view of a cleaning device provided with a lubricant supplying device.

Figure 5:
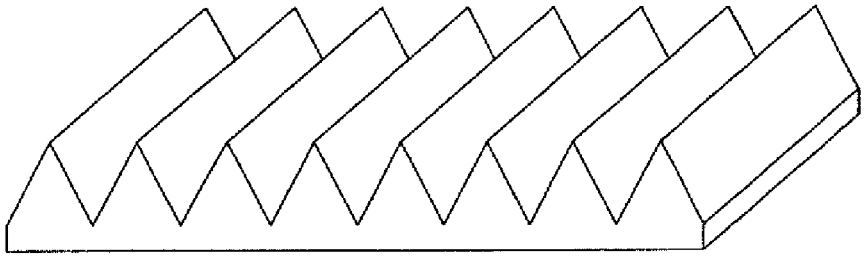
FIG. 5 is a schematic drawing of a concrete example of abraded shape of an abrasive sheet.

This cleaning device is used as a cleaning device of 6Y, 6M, 6C, 6K, and the like, in FIG. 2. Cleaning blade 66A in FIG. 5 is fitted to supporting member 66B. As the material of the cleaning blade, a rubber elastic body is employed. Specifically, for the material, there are known urethane rubber, silicone rubber, fluorine rubber, chloroprene rubber, butadiene rubber, wherein urethane rubber is particularly preferable because of excellent friction characteristic compared with other rubbers.

On the other hand, supporting member 66B is constructed by a plate shape metal material or plastic material. As a metal material, a stainless steel plate, aluminum plate, or an earthquake resistant steel plate is preferable.

The tip of the cleaning blade that is pressed against the surface of the photoreceptor 1 in contact therewith is preferably pressed in the state that a load is applied in the direction (counter direction) opposite to the rotation of the photoreceptor. As shown in FIG. 3, the tip of the cleaning blade preferably forms a pressure contact plane when it contacts with the photoreceptor with pressure.

Preferable values of contact load P and contact angle θ are respectively P is 5 to 40 N/m and θ is 5 to 35 degrees.

The contact load P is a vector value, in the normal direction, of press load P' during when cleaning blade 66A is in press contact with photoreceptor drum 1.

The contact angle θ is an angle between tangent X of the photoreceptor at contact point A and the blade, shown by a dotted line, having not yet been displaced. Numeral 66E represents a rotation shaft that allows the supporting member to rotate, and 66G represents a load spring.

Free length L of the cleaning blade represents, as shown in FIG. 5, the distance between the position of edge B of the supporting member 66B and the tip point of the blade having not yet been displaced. A preferable value of the free length L is in the range from 6 to 15 mm. Thickness t of the cleaning blade is preferably in the range from 0.5 to 10 mm. The thickness of the cleaning blade herein is in the octagonal direction with respect to a surface adhering to the supporting member 66B.

Brush roll 66C is employed as the cleaning device in FIG. 3 which also serves as the agent supply device. The brush roll has functions of removing toner adhering to the photoreceptor 1 and recovering the toner removed by the cleaning blade 66A as well as a function as a lubricant supplying device for supplying the lubricant to the photoreceptor. That is, the brush roll contacts with the photoreceptor 1, rotates in the same direction with the rotation of the photoreceptor at a contact part thereof, removes toner and paper particles on the photoreceptor, conveys toner removed by the cleaning blade 66A, and recovers the removed toner and paper particles to conveying screw 66J. Regarding the path herein, it is preferable that flicker 66I as removing device is contacted with the brush roll 66C, thereby removing the removed such as the toner which has been transferred from the photoreceptor 1 to the brush roll 66C. Further, the toner deposited to the flicker is removed by scraper 66D and recovered into the conveying screw 66J. The recovered toner is taken out outside as waste, or conveyed to a developing vessel through a recycle pipe, not shown, for recycling toner to be reused. As a material of the flicker 66I, metal pipes of stainless steel, aluminum, etc. are preferably used. As the scraper 66D, it is preferable that an elastic plate such as phosphor-bronze plate, polyethylene terephthalate board, polycarbonate plate is employed, and the tip thereof is contacted with the Flicker by a counter method in which the tip forms an acute angle with respect to the rotation direction of the flicker.

A lubricant, solid material of zinc stearate and so on, 66K is pressed by spring load 66S to be fitted to the brush roll, and the brush rubs the lubricant while rotating to supply the lubricant to the surface of the photoreceptor.

As the brush roll 66C, a conductive or semiconductive brush roll is employed.

An arbitrary material can be used as the material of the brush of the brash roll, and, a fiber forming high molecular polymer having a high dielectric constant is preferable. As such a high molecular polymer, for example, rayon, nylon, polycarbonate, polyester, a methacrylic acid resin, acryl resin, polyvinyl chloride, polyvinylidene chloride, polypropylene, polystyrene, polyvinyl acetate, styrene-butadiene copolymer, vinylidene chloride-acrylonitrile copolymer, vinyl chloride-vinylacetate copolymer, vinyl chloride-vinyl acetate-maleic anhydride copolymer, silicone resin, silicone-alkyd resin, phenol-formaldehyde resin, styrene-alkyd resin, polyvinyl acetal, for example, polyvinylbutyral, may be usable. These high molecular polymers can be used solely or in a mixture of each other in two or more high molecular polymers. Preferably, rayon, nylon, polyester, acryl resin, polypropylene may be usable.

As the brush, a conductive or semiconductive brush is employed, wherein the brush is prepared by providing a low resistance material such as carbon into a material of the brush and adjusting the specific resistance of the material of the brush to an arbitrary value.

The specific resistance of a brush bristle of the brush roll is preferably in the range from $10^1$ to $10^6$ Ωcm when measured in the state that a voltage of 500 volts is applied to both ends of a piece of brush bristle with a length of 10 cm at a normal temperature and humidity, i.e., temperature 26° C., and relative humidity 50%.

The brush roll is preferably comprised of a stem of stainless steel or the like and conductive or semiconductive brush bristles having a specific resistance in the range from $10^1$ to $10^6$ Ωcm. If the specific resistance is lower than $10^1$ Ωcm, banding or the like due to electric discharge easily occurs. If the specific resistance is higher than $10^6$ Ωcm, the electrical potential difference from the photoreceptor is low, and cleaning defects easily occur.

A brush bristle for the brush roll preferably has a thickness in the range from 5 to 20 denier. If the thickness of each brush bristle is smaller than 5 denier, the brush roll cannot remove surface deposits due to an insufficient rubbing force. If the thickness of each brush bristle is larger than 20 denier, the brush scratches the surface of the photoreceptor due to stiffness and promotes abrasion, thus shortening the life of the photoreceptor.

The value in "denier" herein is the value of mass of a 9000 m long brush bristle (fiber) measured in grams, the brush bristle constructing the brush.

The density of the brush bristles of the brush is in the range from $4.5\times10^2/cm^2$ to $2.0\times10^4/cm^2$ (number of brush bristles per $cm^2$). If the density is smaller than $4.5\times10^2/cm^2$; the rubbing force is weak due to low stiffness of the bristles, and irregularities are caused in rubbing, which makes it difficult to remove deposits uniformly. If the density is larger than $2.0\times10^4/cm^2$, the photoreceptor is abraded easily by a strong rubbing force due to high stiffness of the bristles, which makes it easy to cause image defects such as togging due to drop in sensitivity and black streaks due to scratches.

The depth of piercing of the brush roll into the photoreceptor is preferably from 0.4 to 1.5 mm. This depth of piercing is equivalent to the load caused by a relative motion between the drum of the photoreceptor and the brush roll and applied to the brush. This load corresponds to a rubbing force applied by the brush to the drum of the photoreceptor from the viewpoint thereof. Therefore, it is preferably to specify the load so that the photoreceptor is rubbed with a proper force.

This depth of piercing is defined by a length of piercing into the photoreceptor with an assumption that a brush bristle goes linearly inside the photoreceptor without curving on the surface of the photoreceptor when the brush contacts with the photoreceptor.

By setting the piercing depth equal to or longer than 0.4 mm, the rubbing force of the brush to be applied to the drum of the photoreceptor is tuned properly, thereby filming of toner, paper particles, and the like onto the surface of the photoreceptor is inhibited, and irregularities on the image are suitably inhibited. By setting the piercing depth equal to or shorter than 1.5 mm, the rubbing force of the brush to be applied to the drum of the photoreceptor is tuned properly, thereby the abrasion amount of the photoreceptor is reduced, fogging due to drop in sensitivity is prevented, and scratches on the surface of the photoreceptor and streaking defects on the image are avoided.

As the stem of a roll part to be used as a brush roll, metals such as stainless steel and aluminum, paper, plastics are mostly used, but not limited to these.

Preferably, the brush roll is provided with a brush through a sticking layer on the surface of a cylindrical stem.

The brush roll preferably rotates such that a contact part thereof moves in the same direction as that of the motion of the surface of the photoreceptor. If the contact part moves in the opposite direction, and there is excessive toner on the surface of the photoreceptor, toner removed by the brush roll may spill out and dirty the recording sheet and the apparatus.

In the motion of the photoreceptor and the brush roll in the same direction as described above, the surface velocity ratio between them is preferably in the range from 1:1 to 1:2. If the rotation speed of the brush roll is smaller than that of the photoreceptor, the toner removal performance of the brush roll is reduced, thus cleaning defects easily occur, and if the rotation speed of the brush roll is greater than that of the photoreceptor, the toner removal performance is excessive to cause blade bounding or curving.

It is provided onto the surface of the electrophotographic photoreceptor in the image forming apparatus, having the intermediate transfer member, whereby the lubricant supplying device is brought into contact with the surface of the electrophotographic photoreceptor in the present invention.

Lubricants

Lubricants will now be described. Lubricants, as described herein, refer to substances which adhere to the surface of electrophotographic photoreceptors and lower their surface energy, and more specifically refer to materials which adhere to the surface, and increase the surface contact angle (being a contact angle to pure water) of electrophotographic photoreceptors at an angle of at least 1 degree.

Materials for lubricants are not particularly limited, as long as they increase the surface contact angle (being a contact angle to pure water) of electrophotographic photoreceptors at an angle of at least 1 degree. The most preferred lubricants are fatty acid metal salts which result in a spreading property and a uniform layer forming property to the photoreceptor surface.

The fatty acid metal salts are preferably metal salts of saturated or unsaturated fatty acids having at least 10 carbon atoms. Examples include aluminum stearate, indium stearate, gallium stearate, zinc stearate, lithium stearate, magnesium stearate, sodium stearate, aluminum palmitate, and aluminum oleate, of which metal stearate are more preferred. These solid materials are preferably utilized by being made into a plate-shape or a bar-shape by applying pressure when necessary.

Of the above-mentioned fatty acid metal salts, fatty acid metal salts, which exhibit high exit velocity at a flow tester, result in high cleavage, whereby it is possible to more effectively form a fatty acid metal salt layer on the surface of the above-mentioned photoreceptor. The exit velocity is preferably in the range of $1\times10^{-7}$ to $1\times10^{-1}$ ml/sec, and is more preferably in the range of $5\times10^{-4}$ to $1\times10^{-2}$ ml/sec. The exit velocity of the flow tester was determined employing Shimazdu Flow Tester "CFT-500" (manufactured by Shimadzu Corp.).

Further, as other examples of the lubricant preferable are fluorine-contained resin powder such as polyvinylidene fluoride and polytetrafluoroethylene. The resin powder has preferably particle size of 0.1 to 2 μm. The resin powder is provided by employing a brush or by mixing with developer on the surface of the photoreceptor. The powder is kept in a container 66K in FIG. 3 and is provided via brush roll 66C in the former case. The powder is mixed with developer in developing device 4K and so on, and is supplied to the surface of the photoreceptor during developing process in the latter case.

The photoreceptor is described.

The photoreceptor composed of at least a photosensitive layer on an electroconductive substrate and a protective layer containing inorganic particles thereon.

The photoreceptor has the following configuration practically.

(1) A configuration in which a charge generation layer and a charge transfer layer as photosensitive layers are provided in sequence on an electroconductive substrate, and a protective layer is provided thereon.

(2) A configuration in which an interlayer is provided on an electroconductive substrate, a charge generation layer and a charge transfer layer as photosensitive layers are provided thereon, and a protective layer is provided thereon.

(3) A configuration in which an interlayer is provided on an electroconductive substrate, a single photosensitive layer containing a charge generation material and a charge transfer material is provided thereon, and a protective layer is provided thereon.

The configuration (2) mentioned above is preferably employed in this invention.

A photoreceptor is practically described as for the configuration (2) as an example.

Electroconductive Support

A sheet or cylinder shaped substrate is employed as the electroconductive substrate Cylinder shape substrate is preferably employed in view of convenience of design of an image forming apparatus. The cylinder shaped substrate can form an image endless by rotation, whose cylindricity is preferably 5 to 40 μm, and more preferably 7 to 30 μm.

A metal drum such as aluminum and nickel, a plastic drum on which aluminum, tin oxide, indium oxide ad so on are deposited, or a paper or plastic drum on which a conductive material is applied thereon are employed. The substrate having specific resistance of $10^3\Omega$ or less at room temperature is preferably employed.

An intermediate layer (or sublayer) may be provided between the support and the foregoing light-sensitive layer to improve adhesion therebetween or to inhibit charge injection from the support. Examples of a material used for the intermediate layer include a polyamide resin, vinyl chloride resin, vinyl acetate resin and their copolymer resin containing at least two repeating units of the foregoing resins. Of these resins is preferred a polyamide resin, which minimizes an increase of residual electric potential along with repeating use. The thickness of an intermediate layer using such a resin is preferably from 0.01 to 0.5 μm.

The intermediate layer used in the invention is preferably cured by using a curable metal resin such as a silane coupling agent or a titanium coupling agent. An intermediated layer using such a curable metal resin is preferably 0.1 to 2 μm thick.

Intermediate layers used in the invention include an intermediate layer containing hydrophobic treated titanium oxide particles (having an average particle size of 0.01 to 1 μm) dispersed in a binder such as a polyamide resin. The thickness of an intermediate layer is preferably from 1 to 20 μm.

Charge Generation Layer

The charge generation layer is composed of a charge generation material and, if required, a binder resin.

Examples of usable CGM include a phthalocyanine pigment, an azo pigment, a perylene pigment and an azulenium pigment. These may be employed singly or in combination.

Employed as binders constituting said charge transporting layer may be any of several resins known in the art. Listed as preferred resins may be formal resins, butyral resins, silicone resins, silicone modified butyral resins, and phenoxy resins. The ratio of said binder resins to said CGMs is preferably from 20 to 600 weight parts with respect to 100 weight parts of the binder resins. The thickness of said CGL layer is preferably from 0.3 to 2 μm.

(Charge Transport Layer)

The charge transport layer comprises charge transport materials (CTM) as well as binders which disperse CTM and form a film. As to other materials, also incorporated may be additives such as antioxidants, if desired.

(Charge Transfer Layer)

As charge transfer materials (CTM) it is possible to employ triphenylamine derivatives, hydrazone compounds, styryl compounds, benzidine compounds, and butadiene compounds. These charge transport materials are commonly dissolved in appropriate binder resins and are then subjected to film formation.

Cited as resins employed in the charge transport layer (CTL) are, for example, polystyrene, acrylic resins, methacrylic resins, vinyl chloride resins, vinyl acetate resins, polyvinyl butyral resins, epoxy resins, polyurethane resins, phenol resins, polyester resins, alkyd resins, polycarbonate resins, silicone resins, melamine resins, and copolymers comprising at least two repeating units of these resins, and other than these insulating resins, high molecular organic semiconductors, such as poly-N-vinylcarbazole. Polycarbonate resin is most preferable among these in view of small water absorbency, good dispersion of CTM and good electrophotographic property.

The ratio of binder resins to charge transport materials is preferably from 50 to 200 weight parts per 100 weight parts of the binder resins.

(Protective Layer)

The protective layer is formed by applying a coating composition composed of a binder resin and organic particles on the charge transport layer, and then the surface is additionally processed so that its surface has specific Rsm and Rsk values. Thickness of the protective layer is generally 0.5 to 15 μm, and preferably 1 to 10 μm.

It is preferable that the protective layer contains an antioxidant.

The preferable examples of the inorganic particles include silica, zinc oxide, titanium oxide, tin oxide, antimony oxide, indium oxide, bismuth oxide, tin doped indium oxide, antimony or tantalum doped tin oxide and zirconium oxide. Particularly preferable examples are hydrophobic silica on which surface is subjected to hydrophobic treatment, hydrophobic alumina, hydrophobic zirconia and powder sintered silica.

Number average primary particle diameter of the inorganic particles is preferably 1 to 300 nm, and particularly preferably 5 to 100 nm.

The number average primary particle diameter of the inorganic particles is calculated by observing, for example, randomly selected 300 particles enlarged by a transmittal electron microscope with magnification of 10,000 times, and number average of Fere diameter is obtained by image analysis.

Binder resins used for the protective include a thermoplastic resin and a thermocurable resin. Preferable examples thereof include a polyvinyl butyral resin, an epoxy resin, a polyurethane resin, a phenol resin, a polyester resin, an alkyd resin, a polycarbonate resin, a silicone resin and melamine resin. The polyester resin and the polycarbonate resin are more preferable, and the polycarbonate resin is particularly preferable among them.

A method for providing the specified RSm and Rsk values on the protective layer surface is described below.

(Abrasion Treatment)

A method is preferable in which the protective layer coating liquid is coated and dried to form a coated layer and then the layer is additionally treated to be provide the specified shaped roughness curve profile though the method for providing the specified RSm and Rsk values on the protective layer surface is no specifically limited.

In concrete, the method by abrasion treatment onto the surface of protective layer for providing the specified shaped roughness curve as described below is preferred.

In the invention, a method is preferred in which the protective layer is abraded by using a sheet-shaped abrasive material. The abrasive sheet has an abrasive surface on which regularly arranged projection portions containing particles. Grooves can be uniformly formed on the full surface of the photoreceptor by applying such the abrasion method.

The abrasive material capable of forming the specified Rsm and Rsk is selected for use. As a preferable abrasive material, one prepared by providing a layer mainly constituted by abrasive grains on a deformable flexible support.

The sheet-shaped abrasive material has protruded portions on the abrasive surface for abrading the photoreceptor surface and contains abrasive grains at the protruded portions.

Preferable sheet-shaped abrasive material has the protruded portion having a triangle cross section and containing particles so called as abrasive grains therein. Diamond is particularly preferred as the abrasive grains contained in the protruded portion constituting the sheet-shaped abrasive material.

Triangular shape of cross section of the protruded portions constituting the sheet-shaped abrasive means as shown in FIG. 5 is particularly preferable.

Figure 6:
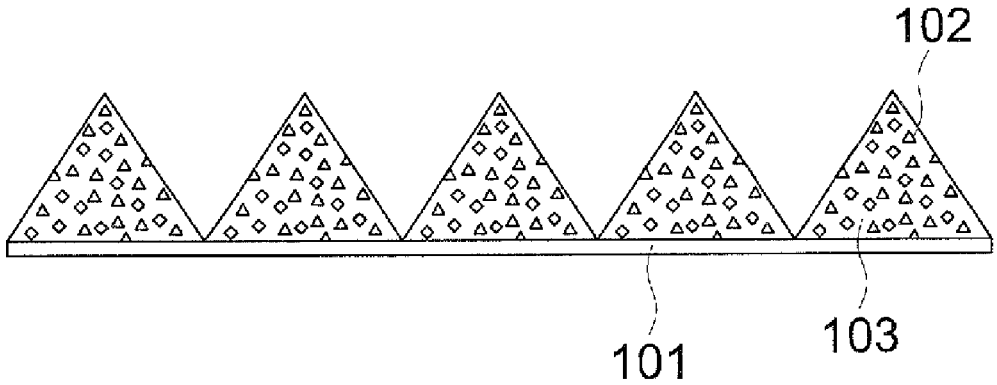
FIG. 6 is a schematic drawing of cross section of an abrasive sheet.

FIG. 6 is a schematic drawing of the cross section of constitution of the abrasive means shown in FIG. 5. The abrasive means comprises protruded portions containing abrasive grains 102 and a binder 103 arranged on a substrate 101.

As the substrate 101, flexible resin film can be used, by which strong adhesion force can be obtained with the binder resin 103 containing the abrasive grains constituting the protruded portion. In concrete, known resin materials capable of forming a sheet can be cited, for example, polyester resin such as poly(ethylene terephthalate), polyamide resin such as nylon film, cellulose type resin such as triacetyl cellulose film, polyurethane resin, and epoxy resin. Among them, poly (ethylene terephthalate) resin film is particularly preferable. A thickness of the substrate 101 of about from 10 to 100 μm, preferably from 60 to 90 μm, is suitable.

The abrasive grain 102 is contained in the binder resin 103 and substantially performs abrasion of the photoreceptor surface.

As the material usable as the abrasive grain 102, aluminum oxide, diamond, chromium oxide, silicon carbide, iron oxide, cerium oxide, corundum, silicon nitride, molybdenum carbide, tungsten carbide and silicon oxide are cited. An average diameter of the abrasive grain 102 of about 0.01 to 50 μm is usable as the abrasive grain. Particular superior results can be obtained when diamond grains having an average diameter of from 0.1 to 10 μm are used. The average diameter of the grains is a median diameter $D_{50}$ determined by a centrifugal precipitation method.

Two or more kinds of abrasive grains having different average grain diameter may be employed.

FIG. 4 is a schematic drawing of the situation of abrading the photoreceptor surface.

As is shown in FIG. 4, the abrading of the photoreceptor surface is carried out by contacting the sheet-shaped abrasive material with the photoreceptor surface while rotating the photoreceptor.

Figure 4A:
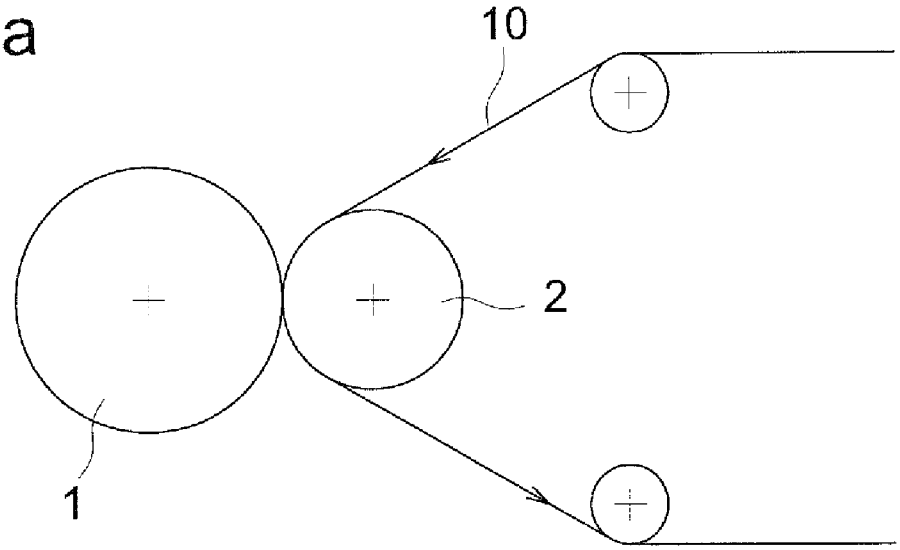
FIGS. 4*a* and 4*b* show schematic drawing of the situation of abrading the photoreceptor surface.
Figure 4B:
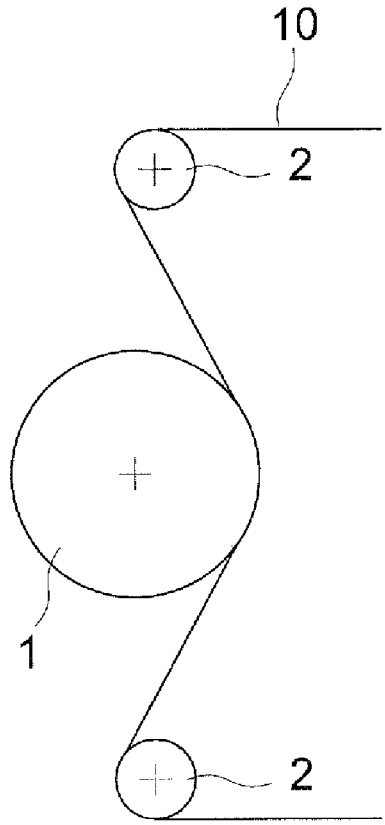

The abrading methods shown in FIG. 4 are known methods. The method shown in FIG. 4*a* is one so called as backup roller pressing method, in which the abrasion is carried out by pressing the sheet-shaped abrasive material 10 to the photoreceptor surface by a roller 2 positioned at the backside of the abrasive material. The method shown in FIG. 4*b* is a method so called as a guide roller nearing method, in which the abrasion is carried out by applying tension to the abrasive material by plural rollers 2 arranged at backside of the sheet-shaped abrasive material 10. In the invention, the sheet-shaped abrasive material is arranged as above to be contacted with the photoreceptor surface and the abrasion of the photoreceptor surface is carried out in such the situation.

The values of RSm and Rsk can be controlled by controlling the abrasion conditions such as the rotating rate or transfer speed of the sheet-shaped abrasive material and the photoreceptor.

The toner to be used in the invention is described below.

<<Toner>>

The toner to be used in the image forming apparatus relating to the invention is preferably one having a low temperature fixing suitability by which the electric consumption can be reduced on the occasion of high speed printing and a particle size of from 3 to 8 μm in number-based median diameter $D_{50}$ for obtaining high quality printed images.

The number-based median diameter $D_{50}$ of the toner is determined by Coulter Counter 3, manufactured by Beckman Coulter Inc.

The production method of the toner is described below.

A method including a process for desalting/fusing composite resin particles obtained by a multi-step polymerization method and colorant particles is preferred as the production method of the toner to be used in the invention.

An example of preferable toner production method is described below.

The production method may include the following processes:

(1) A dissolution/dispersion process for dissolving or dispersing an ester compound having specific structure into a radical polymerizable monomer (2) A polymerization process for preparing a dispersion of fine resin particles (3) A fusion process for fusing the resin fine particles with the colorant particles to obtain colored particles (associated particles) in an aqueous medium (4) A cooling process for cooling the dispersion of colored particles (5) A washing process for separating the colorant particles from the liquid phase of the colored particle dispersion and removing surfactant from the colored particles (6) A drying process for drying the washed colored particles, and according to necessity (7) A process for adding an external additive to the dried colored particles.

The number-based median diameter $D_{50}$ can be controlled by controlling the fusion process for fusing the resin fine particles and the colorant particles to obtain the colored particles (associated particles).

Example

The invention will now be detailed with reference to examples.

<<Preparation of Photoreceptor>>

<Preparation of Abrasive Sheet>

The following abrasive sheets are provided. Each of the abrasive sheets has abrasive grains bounded to polyethylene terephthalate film having a thickness of 75 μm obtained in market with a binder (resorcinol resin from market). The substance and average particle size of the abrasive are shown. These are abrasive sheets having abrasive surface on which protruded portions are regularly arranged.

| Abrasive Sheet No. | Abrasive grain | Average Grain Size |
|---|---|---|
| 1 | Diamond | 2.5 μm |
| 2 | Diamond | 2.5 μm and 0.2 μm |
| 3 | Diamond | 10 μm |
| 4 | Alumina | 3.5 μm |
| 3 | Alumina | 10 μm |

The abrasive sheet 2 contains two kinds of abrasive grains having different average grain size each other.

<Preparation of Photoreceptor 1>

(Electroconductive Substrate)

The surface of a cylindrical aluminum substrate having 362 mm length and diameter of 60 mm was shaved to prepare an electroconductive substrate having a surface roughness Rz of 0.92 μm after washing.

(Inter Layer)

| | |
|---|---|
| Polyamide resin (CM800: Toray Co., Ltd.) | 1 part by weight |
| Titanium oxide (SMT500SAS: TAYCA CORPORATION, having subjected to surface treatment with silica, alumina and methylhydrogenpolysiloxane) | 3 parts by weight |
| Methanol | 10 parts by weight |

The mixture was dispersed for 10 minutes by a sand mill according to a batch method to obtain dispersion for the inter layer.

Inter Layer Coating Composition

The dispersion liquid for interlayer was diluted by 2 times by a mixed solvent the same as in the following, and then stood for 24 hours and filtered through RIGIMESH having nominal filter accuracy of 5 μm filter produced by Nihon Pall Co., Ltd. at pressure of $5\times10^4$ Pa, to prepare an interlayer coating liquid.

The above-prepared coating liquid was coated on the substrate so that the dry thickness of the coated layer was 2 μm.

(Charge Generation Layer)

Charge generation layer coating composition was prepared by the mixing the following materials and dispersed by employing a sand mill. The charge generation layer was formed by coating the obtained charge generation layer coating composition on the inter layer by dip coating apparatus so as to have dry thickness of 0.3 μm.

| Charge generation layer coating composition | |
|---|---|
| Charge generation substance: Titanylphthalocyanine pigment* | 20 parts by weight |

-continued

| Charge generation layer coating composition | |
|---|---|
| Silicone resin (KR-5240, Shin-Etsu Chemical Co., Ltd.) | 10 parts by weight |
| t-butyl acetate | 700 parts by weight |
| 4-methoxy-4-methyl-2-pentanone | 300 parts by weight |

*Titanylphthalocyanine pigment having the maximum peak of the Cu-Kα X-ray diffraction spectrum at Bragg angle 2θ (±0.2) of 27°

(Charge Transportation Layer)

| | |
|---|---|
| Charge transportation substance (4,4'-dimethyl-4''-(β-phenylstyryl)triphenylamine) | 225 parts by weight |
| Polycarbonate resin (Z300: Mitsubishi Gas Chemical Company Inc.) | 300 parts by weight |
| Antioxidant (Irganox1010: Nihon Ciba-Geigy Co., Ltd.) | 6 parts by weight |
| Dichloromethane | 2000 parts by weight |
| Silicone oil (KF-54: Shin-Etsu Chemical Co., Ltd.) | 1 part by weight |

The above-mentioned were mixed and dissolved to prepare a charge transportation coating liquid was prepared. The coating liquid was coated on the above-prepared charge generation layer by a dipping coating method and dried at 110° C. for 70 minutes to form the first charge transportation layer having a dry thickness of 18.0 μm.

(Protective Layer)

The protective layer was formed as following way.

(The First Mixture)

| | |
|---|---|
| Silica (Number average primary particle diameter of 40 nm) | 3 parts by weight |
| Tetrahydrofuran | 54 parts by weight |
| Toluene | 18 parts by weight |

The above composition was mixed and was subjected to mechanical stirring and ultrasonic dispersion by UH600MC (by SMT Co., Ltd.) at 35 KHz, 600 W for 30 minutes during dispersion was circulated.

(Preparation of Binding Resin Liquid)

The following compounds were mixed to prepare a binding resin liquid.

| | |
|---|---|
| Binding resin (polycarbonate, Z300: Mitsubishi Gas Chemical Company Inc.) | 3 parts by weight |
| Tetrahydrofuran | 48 parts by weight |
| Toluene | 12 parts by weight |

(The Second Mixture)

The binding resin liquid prepared above was added to the first mixture to prepare the second mixture. The mixture was subjected to mechanical stirring and ultrasonic dispersion by UT604 (by Sharp Corp.) at 35 KHz, 600 W for 30 minutes during dispersion was circulated. After that 20 parts by weight of a charge transportation material 4,4'-dimethyl-4'' (β-phenylstyryl)triphenylamine was added and dissolved to obtain protective layer coating composition.

The protective layer was formed by applying the obtained protective layer coating composition onto the charge transportation layer and dried at 110° C. for 70 minutes to obtain the protective later having a dry thickness of 6.0 μm.

(Surface Processing of Protective Layer)

Surface of the protective layer was subjected to abrasion treatment by employing an abrasion apparatus of FIG. 4(*a*) to which the abrasive sheet 1 was set. The abrasion was conducted by controlling rotation speed of the photoreceptor, conveying speed of the abrasive sheet, feeding speed and abrasion depth.

Photoreceptor No. 1 was obtained by the abrasion treatment, the photoreceptor having RSm of 5.6 μm and Rsk of −2.4. The values RSm and Rsk were measured by a way described before.

Preparation of Photoreceptors No. 2 to 14

Photoreceptors No. 2 to 14 were obtained in the same way as Photoreceptor No. 1, except that inorganic particles employed in the preparation pf the Photoreceptor No. 1 and the surface abrasion treatment method was modified as shown in Table 1. The thickness of the protective layer did not substantially change through the abrasion treatment.

In Table 1 inorganic particles employed in the preparation of the photoreceptors, abrasion sheet surface roughness profile are listed.

TABLE 1

| Photo- | Inorganic particles in protective layer | | | Abrasion Processing | | | Surface roughness profile | |
|---|---|---|---|---|---|---|---|---|
| | | | | Abrasive | Abrasive grain | | | |
| receptor No. | Compound | Particle diameter (nm) | Content (% by weight) | sheet No. | Abrasive substance | Average grain size | RSm (mm) | RSk |
| 1 | Silica | 40 | 10 | 1 | Diamond | 2.5 | 5.6 | −2.4 |
| 2 | Silica | 40 | 10 | 2 | Diamond | 2.5 & 0.2 | 4.2 | −2.9 |
| 3 | Silica | 40 | 10 | 3 | Diamond | 10 | 2.8 | −0.8 |
| 4 | Silica | 7 | 10 | 2 | Diamond | 2.5 & 0.2 | 8.4 | −2.2 |
| 5 | Silica | 40 | 20 | 2 | Diamond | 2.5 & 0.2 | 12.6 | −1.5 |
| 6 | Silica | 80 | 5 | 1 | Diamond | 2.5 | 5.8 | −1.1 |
| 7 | Silica | 7 | 40 | 2 | Diamond | 2.5 & 0.2 | 3.8 | −2.5 |
| 8 | Alumina | 20 | 10 | 3 | Diamond | 10 | 2.0 | −0.2 |
| 9 | Titania | 40 | 30 | 1 | Diamond | 2.5 | 7.0 | −2.9 |
| 10 | Silica | 40 | 10 | 4 | Alumina | 3.5 | 7.2 | −4.0 |
| 11 | Silica | 40 | 10 | 5 | Alumina | 10 | 12.8 | 0.5 |
| 12 | Titania | 100 | 5 | 4 | Alumina | 3.5 | 10.4 | −1.5 |
| 13 | Titania | 5 | 40 | 5 | Alumina | 10 | 1.6 | −0.7 |
| 14 | None | — | — | 2 | Diamond | 2.5 & 0.2 | 6.2 | −2.4 |

<<Preparation of Toner>>

Toners were prepared in the following way.

<Preparation of Toner Bk1>

(Preparation of Colored Particle Bk1)

(1) Synthesis of Low Molecular Weight Resin Particles

Into a four-mouthed flask on which a thermal sensor, a cooler and a stirrer were attached, 509.33 parts by weight of styrene, 88.67 parts by weight of n-butylacrylate, 34.83 parts by weight of methacrylic acid, 21.83 parts by weight of t-dodecylmercaptan and 66.7 parts by weight of Compound (1) are charged, and the internal temperature was raised by 80° C., the temperature was kept during the contents were stirred until the Compound (1) was dissolved. A surfactant solution prepared by dissolving 1.0 part by weight of sodium dodecylbenzenesulfonate in 2,700 parts by weight of deionized water was heated so that the internal temperature was raised by 80° C., and temperature was maintained. The monomer solution dissolving the Compound (1) was added to the heated surfactant solution while stirring, and then they were emulsified by an ultrasonic emulsifier to obtain emulsion. The obtained emulsion liquid was charged to a four-mouthed flask on which a thermal sensor, a cooler, a stirrer and a nitrogen introduction device were attached, and the internal temperature was keeping at 70° C. while stirring under nitrogen atmosphere, a polymerization initiator aqueous solution, which is formed by dissolving 7.52 parts by weight of ammonium persulfate in 500 parts by weight of deionized water, was added and polymerization reaction was conducted for 4 hours. The resultant was cooled to room temperature and was subjected to filtering to obtain resin particles. Polymerization residue was not observed and stable particles were obtained. This is called Resin Particle Dispersion L-1.

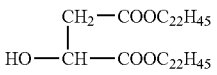

(1)

The average particle diameter of Resin Particle Dispersion L-1 was 125 nm according to measurement by the electrophoretic light scattering photometer ELS-800, manufactured by Otsuka Electronics Co., Ltd. Glass transition temperature was 58° C. by means of DSC. Solid content of Resin Particle Dispersion L-1 the measured after standing dry was 20% by weight.

(2) Synthesis of High Molecular Weight Resin Particles

Into a four-mouthed flask on which a thermal sensor, a cooler and a stirrer were attached, 92.47 parts by weight of styrene, 30.40 parts by weight of n-butylacrylate, 3.80 parts by weight of methacrylic acid, 0.12 parts by weight of t-dodecylmercaptan and 13.34 parts by weight of Compound (1) are charged, and the internal temperature was raised by 80° C., the temperature was kept during the contents were stirred until the Compound (1) was dissolved. A surfactant solution prepared by dissolving 0.27 part by weight of sodium dodecylbenzenesulfonate in 540 parts by weight of deionized water was heated so that the internal temperature was raised by 80° C., and temperature was maintained. The monomer solution dissolving the Compound (1) was added to the heated surfactant solution while stirring, and then they were emulsified by an ultrasonic emulsifier to obtain emulsion. The obtained emulsion liquid was charged to a four-mouthed flask on which a thermal sensor, a cooler, a stirrer and a nitrogen introduction device were attached, and the internal temperature was keeping at 70° C. while stirring under nitrogen atmosphere, a polymerization initiator aqueous solution, which is formed by dissolving 0.27 parts by weight of ammonium persulfate in 100 parts by weight of deionized water, was added and polymerization reaction was conducted for 4 hours. The resultant was cooled to room temperature and was subjected to filtering to obtain resin particles. Polymerization residue was not observed and stable particles were obtained. This is called Resin Particle Dispersion H-1.

The average particle diameter of Resin Particle Dispersion H-1 was 108 nm according to measurement by the electrophoretic light scattering photometer ELS-800, manufactured by Otsuka Electronics Co., Ltd. Glass transition temperature was 59° C. by means of DSC. Solid content of Resin Particle Dispersion L-1 the measured after standing dry was 20% by weight.

(3) Preparation of Colored Particle Bk1

Into a four-mouthed flask on which a thermal sensor, a cooler and a stirrer were attached, 250 parts by weight (in terms of solid) of Resin Particle Dispersion H-1, 1,000 parts by weight (in terms of solid) of Resin Particle Dispersion L-1, 900 parts by weight of deionized water, and carbon black dispersion (dispersion of 20 parts by weight of carbon black REGAL 330R (Cabot Corp.) in surfactant aqueous solution containing 9.2 parts by weight of sodium dodecylbenzenesulfonate dissolved in 160 parts by weight of deionized water) were charged, and pH was adjusted to 10 by adding 5N sodium hydroxide solution while stirring.

Then an aqueous solution prepared by dissolving 28.5 parts by weight of magnesium chloride hexahydrate in 1,000 parts by weight of deionized water was added while stirring at room temperature, and heated so that inner temperature reached at 95° C. Particle diameter of the dispersion was measured by COULTER COUNTER 3 (Beckman Coulter Inc.) keeping the temperature at 95° C., aqueous solution containing 80.6 parts by weight of sodium chloride was dissolved in 700 parts by weight of deionized water was added and continued the reaction for 6 hours at keeping temperature at 95° C. After the completion of reaction dispersion of associated particles (95° C.) was cooled down to 45° C. taking 10 minutes. The obtained associated particles were washed by repeating re-suspension and filtration and dried. The particles are called Colored Particles Bk1. Number based median particle diameter $D_{50}$ of the Colored Particles Bk1 was 6.5 μm measured by means of COULTER COUNTER 3 (Beckman Coulter Inc.).

One percent by weight of hydrophobic silica particles having a number average primary particle diameter of 12 nm and hydrophobicity of 68, and one percent by weight of hydrophobic titanium oxide particles having a number average primary particle diameter of 20 nm and hydrophobicity of 63 were added to the Colored Particles Bk1 and they were mixed by employing Henschel mixer (Mitsui Mike Kakoki). Course particles were removed by a sieve having an aperture of 45 μm to obtain Toner Bk1. Number based median particle diameter $D_{50}$ was not changed before and after of the addition of hydrophobic silica and hydrophobic titanium oxide particles.

<Preparation of Toner Bk2>

Toner Bk2 was prepared by the same way as preparation of Toner Bk1, except that condition to add aqueous solution of sodium hydroxide was changed so as to obtain particles having a number based median particle diameter $D_{50}$ of 5.0 μm.

<Preparation of Toner C1 and Toner C2>

Toner C1 and Toner C2 were prepared by the same way as preparation of Toner Bk1 and Bk2, respectively except that REGAL 330R was replaced by a same amount of C.I. Pigment Blue 15:3.

<Preparation of Toner M1 and Toner M2>

Toner M1 and Toner M2 were prepared by the same way as preparation of Toner Bk1 and Bk2, respectively except that REGAL 330R was replaced by a same amount of C.I. Pigment Red 122.

<Preparation of Toner Y1 and Toner Y2>

Toner Y1 and Toner Y2 were prepared by the same way as preparation of Toner Bk1 and Bk2, respectively except that REGAL 330R was replaced by a same amount of C.I. Pigment Yellow 17.

A group of Toner Bk1, Toner C1, Toner M1 and Toner Y1 is called Toner Group 1, as well as a group of Toner Bk2, Toner C2, Toner M2 and Toner Y2 is called Toner Group 2.

<<Preparation of Developer>>

Silicone resin coated ferrite carrier having a volume average median diameter of 60 μm was mixed with each of the above toners to prepare Developer Bk1 and Developer Bk2, Developer C1 and Developer C2, Developer M1 and Developer M2, and Developer Y1 and Developer Y2 each having a toner concentration of 6% by weight.

Resin powder was supplied instead of solid lubricant by employing powder supplying container in Example 9. Lubricant was not applied in Comparative Example 6.

<<Evaluation>>

A digital printer Bizhub Pro C6500, manufactured by Konica Minolta Business Technologies Inc., was employed for evaluation apparatus. The photoreceptors and Toners as prepared were installed to the printer, respectively, and printing test was conducted. Twenty thousand A3 size sheets of half tone solid image having image density of 0.4 in each color were printed at room temperature and humidity (20° C. and 60% RH).

Streak Defect

An image defect was visually evaluated by observing degree of streak defect at initial print and in every 1,000th print.

Evaluation Criteria

A: No streak defects observed up to 20,000th sheet (Excellent)

B: Fine streak defects slightly observed at 20,000th sheet (Good)

C: A sharp streak defects observed at 20,000th sheet (Problem in practical application)

Rain-Drop Detect

An image defect was visually evaluated by observing degree of rain-drop generated according to photoreceptor's rotation cycle and having a diameter of 0.4 mm or more at initial print and in every 1,0000th print. Number of raindrops in one cycle of photoreceptor rotation was measured.

Evaluation Criteria

A: Number of rain-drops is 0 or up to 2 at 20,000th sheet (Excellent)

B: Number of rain-drops is 3 to 10 at 20,000th sheet (No problem in practical application)

C: Number of rain-drops is 11 or more at 20,000th sheet (Problem in practical application)

The result is summarized in Table 2.

TABLE 2

| | | | | | | Image evaluation | | |
|---|---|---|---|---|---|---|---|---|
| Example No. | Lubricant | RSm (mm) | RSk | $D_{50}$ (μm) | $RSm/D_{50}$ | Streak | Rain-drop | Remarks |
| Example 1 | ZnSt | 5.6 | −2.4 | 6.5 | 0.86 | A | A | |
| Example 2 | ZnSt | 4.2 | −2.9 | 5.0 | 0.84 | A | B | |
| Example 3 | ZnSt | 2.8 | −0.8 | 6.5 | 0.43 | A | B | |
| Example 4 | ZnSt | 8.4 | −2.2 | 6.5 | 1.29 | A | A | |
| Example 5 | ZnSt | 12.6 | −1.5 | 6.5 | 1.94 | B | A | |
| Example 6 | ZnSt | 5.8 | −1.1 | 5.0 | 1.16 | A | A | |
| Example 7 | ZnSt | 3.8 | −2.5 | 6.5 | 0.58 | A | A | |
| Example 8 | CaSt | 2.0 | −0.2 | 5.0 | 0.40 | B | B | |
| Example 9 | PVdF | 7.0 | −2.9 | 5.0 | 1.40 | B | B | |
| Comparative Example 1 | ZnSt | 7.2 | −4.0 | 6.5 | 1.11 | B | C | Rain-drop defect observed at 2,000th sheet. |
| Comparative Example 2 | ZnSt | 12.8 | 0.5 | 6.5 | 1.97 | C | B | Streak defect observed from initial print |
| Comparative Example 3 | ZnSt | 10.4 | −1.5 | 5.0 | 2.08 | B | C | Rain-drop defect observed at 5,000th sheet. |
| Comparative Example 4 | ZnSt | 1.6 | −0.7 | 5.0 | 1.32 | B | C | Rain-drop defect observed at 2,000th sheet. |
| Comparative Example 5 | ZnSt | 6.2 | −2.4 | 6.5 | 0.95 | B | C | Rain-drop defect observed at 15,000th sheet. |
| Comparative Example 6 | None | 5.6 | −2.4 | 6.5 | 0.86 | B | C | Rain-drop defect observed at 1,000th sheet. |

ZnSt: Zinc stearate,
CaSt: Calcium stearate,
PVdF: Polyfluorinate vinylidene

The result shown in Table 2 demonstrates that good prints without streak defect or rain-drop defect were obtained up to 20,000th sheet in Examples 1 through 9. Some problems of streak defect or rain-drop defect were observed among 20,000 sheets in Comparative Examples 1 through 6.

The invention claimed is:

1. An electrophotographic image forming method comprising steps of:

electrically charging a photoreceptor, imagewise exposing the photoreceptor so that a latent image is formed on the photoreceptor, supplying a lubricant on a surface of the photoreceptor, developing the latent image with a toner so that a toner image is formed on the photoreceptor, transferring the toner image, and removing residual toner on a surface of the photoreceptor by a cleaning device;

wherein the photoreceptor has an electro-conductive substrate, a photosensitive layer and a protective layer containing inorganic particles, a ratio $RSm/D_{50}$ is from 0.4 to 2.0, wherein RSm is an average length of surface roughness profile element of the protective layer in the direction making a right angle with the driving direction in μm, and $D_{50}$ is a number-based median diameter of the toner in μm, and a skewness of a surface roughness profile of the photoreceptor in the direction making a right angle with the driving direction of the photoreceptor Rsk is from −3.0 to 0.0.

2. The electrophotographic image forming method of claim 1, wherein the ratio $RSm/D_{50}$ is 0.5 to 1.5.

3. The electrophotographic image forming method of claim 1, wherein the Rsk is from −2.5 to −0.5.

4. The electrophotographic image forming method of claim 3, wherein the Rsk is from −2.5 to −1.0.

5. The electrophotographic image forming method of claim 1, wherein a number-average primary particle diameter of the inorganic particles is from 1 to 300 nm.

6. The electrophotographic image forming method of claim 5, wherein a number-average primary particle diameter of the inorganic particles is from 5 to 100 nm.

7. The electrophotographic image forming method of claim 1, wherein a thickness of the protective layer is from 1 to 10 μm.

8. The electrophotographic image forming method of claim 1, wherein the lubricant is a fatty acid metal salt.

9. The electrophotographic image forming method of claim 8, wherein the lubricant is zinc stearate.

10. The electrophotographic image forming method of claim 1, wherein a number-based median diameter of the toner $D_{50}$ is from 3 to 8 μm.

* * * * *